United States Patent [19]

Lang et al.

[11] Patent Number: 4,465,442

[45] Date of Patent: Aug. 14, 1984

[54] ROTARY PISTON PUMP WITH PRESSURE EQUALIZATION CHAMBERS FOR THE SHAFT SPLIT SEALS

[75] Inventors: Hermann Lang, Rechtenbach-Hüttenberg; Jürgen Steinmüller, Biebertal, both of Fed. Rep. of Germany

[73] Assignee: Arthur Pfeiffer Vakuumtechnik Wetzlar GmbH, Asslar, Fed. Rep. of Germany

[21] Appl. No.: 331,798

[22] Filed: Dec. 17, 1981

[30] Foreign Application Priority Data

Dec. 18, 1980 [DE] Fed. Rep. of Germany ..... 3047699

[51] Int. Cl.[3] ..... F04C 18/18; F04C 27/00; F04C 29/00; F16J 15/40

[52] U.S. Cl. ..... 418/2; 418/95; 418/104; 418/206; 418/DIG. 1; 277/226

[58] Field of Search ..... 418/2, 95, 104, 205, 418/206, DIG. 1; 277/3, 15, 226

[56] References Cited

U.S. PATENT DOCUMENTS

| | | | |
|---|---|---|---|
| 1,696,882 | 12/1928 | Hassler | 418/95 |
| 2,115,325 | 4/1938 | Behringer | 418/95 |
| 2,495,601 | 1/1950 | Rawson | 418/2 |
| 2,496,676 | 2/1950 | Rawson | 418/DIG. 1 |
| 2,642,808 | 6/1953 | Thomas | 418/206 |
| 2,785,851 | 3/1957 | Menon | 418/2 |
| 2,903,970 | 9/1959 | Elovitz et al. | 277/15 |
| 3,292,847 | 12/1966 | Herrick | 418/95 |
| 3,919,854 | 11/1975 | Denis | 277/3 |

FOREIGN PATENT DOCUMENTS

| | | | |
|---|---|---|---|
| 2450598 | 4/1975 | Fed. Rep. of Germany | 418/95 |
| 2700226 | 7/1978 | Fed. Rep. of Germany | 418/104 |
| 241323 | 10/1925 | United Kingdom . | |
| 559226 | 2/1944 | United Kingdom | 418/95 |
| 559729 | 2/1944 | United Kingdom . | |
| 680001 | 10/1952 | United Kingdom . | |
| 1570266 | 6/1980 | United Kingdom . | |

*Primary Examiner*—John J. Vrablik

*Attorney, Agent, or Firm*—Toren, McGeady and Stanger

[57] ABSTRACT

A rotary piston pump includes a casing and partitions within the casing defining an expansion chamber and with a gear and bearing chamber on one side of the expansion chamber and a bearing chamber on the other side. The partitions between the expansion chamber and the bearing and gear and bearing chambers are provided with passages for receiving shafts serving for the transmission of the rotary movement from gears to the pistons of the pumps. The passages between the chambers are provided with split seals which are composed of two parts separated by a pressure equalization chamber.

9 Claims, 1 Drawing Figure

ROTARY PISTON PUMP WITH PRESSURE EQUALIZATION CHAMBERS FOR THE SHAFT SPLIT SEALS

BACKGROUND OF THE INVENTION

The present invention relates generally to vacuum pumps and more particularly to a rotary piston pump, having an expansion chamber with a gear and bearing chamber on one side of the expansion chamber and a bearing chamber on the other side, wherein the passages between the expansion chamber and the other chambers are separated by means of split seals.

In rotary piston pumps, two or more pistons rotate in an expansion chamber defined by a pump casing. The pistons rotate in opposite directions and perform a rolling movement relative to one another without mutual contact. The pistons also act to seal off the suction side from the outlet side of the pump along a line or surface. The movement of the pistons is effected by gears located in special gear chambers which are separated from the expansion chamber by means of partitions. These partitions between the expansion chamber and the gear chambers are provided with passages which receive shafts serving for the transmission of the rotary movement from the gears to the pistons. The gear chambers are filled with oil up to a certain level, the oil being supplied to shaft bearings and gear wheels, for example, by means of centrifugal disks.

Since a rotary piston pump is intended to operate without oil in the expansion chamber, oil and other lubricants must be prevented from penetrating into the expansion chamber from the gear chambers. Conversely, any substance present in the expansion chamber which could contaminate or destroy the lubricants in the gear chambers must be prevented from penetrating into the gear chambers. Therefore, it is necessary to ensure that the expansion chamber and the gear chambers are effectively separated at the passages receiving the shafts.

In order to achieve this separation, shaft seals are arranged in the bearing plates disposed between the rolling bearings and the passages leading into the expansion chamber. However, these seals have the disadvantage that they wear out very rapidly due to unavoidable friction. To avoid this disadvantage, it has been suggested to equip the passages receiving the shafts with split seals. These split seals do not provide an absolute sealing action, however, they are capable of preventing liquid particles from passing from one chamber into the other and, furthermore, they are not subject to wear.

Since, for manufacturing reasons, not every gap in the split seals is of the same size, pressure differences may occur which lead to compensating flows from one shaft passage to another, even when the initial pressure and the suction pressure remain constant. This effect occurs especially in multistage pumps where different pressures prevail at the various shaft passages. The above-mentioned compensating flows prevent the rotary piston pump from operating at maximum efficiency because they may force lubricant vapors from the gear chambers into the expansion chamber which should remain free of oil, and, similarly, they may force vapors from the expansion chamber into the gear chambers where the vapors may condense and contaminate or destroy the lubricants. Since the pressure compensation between the shaft passages takes place in part above the oil level in the gear chambers, spray oil may additionally be conveyed from the gear chambers into the expansion chamber and it would no longer be ensured that the expansion chamber is free of oil.

In order at least to reduce the amount of contaminating gases or vapors conducted from the gear chambers into the expansion chamber or vice versa, in accordance with a conventional method, the shaft openings are bled and evacuated individually by means of separate suction lines. This leads to high manufacturing costs, particularly of multistage pumps.

Another disadvantage of conventionally constructed pumps resides in that there is no possibility of checking for or removing undesirable substances occurring at the passages between the expansion chamber and the gear chambers. These substances may lead to failures of the pumps, particularly when such substances accumulate in large quantities.

An object of the present invention is to overcome the above and other disadvantages in rotary piston pumps, and to provide a pump capable of delivering oil-free gases and vapors by effectively separating the expansion chamber from the gear chambers.

Another object of the present invention is to provide a possibility for monitoring the operation of the pump.

SUMMARY OF THE INVENTION

In accordance with the present invention, a rotary piston pump includes a casing and partitions defining within the casing an expansion chamber with a gear and bearing chamber on one side of the expansion chamber and a bearing chamber on the other side, and at least two shaft passages extending between the expansion chamber and each of the chambers. The expansion chamber is separated from the other chambers by means of split seals. The split seals are each composed of two parts which are separated by pressure equalization chambers.

In accordance with a preferred embodiment of the present invention, the pressure equalization chambers connect all of the shaft passages located on one side of the expansion chamber.

The pressure equalization takes place in these pressure equalization chambers. As a result, any additional flows of gas through the oil-containing chambers are prevented from conveying oil particles into the expansion chamber. The pressure equalization between the gear and bearing chamber and the adjacent pressure equalization chamber and between the bearing chamber and the adjacent bearing chamber can be effected by separate connecting lines equipped with oil filters.

A bore is arranged between the two parts of the split seals. This bore may be provided with a vacuum-tight inspection glass which can be observed from the outside and/or a moisture measuring probe. Thus, an observation device is provided making it possible to monitor the operation of the pump. If, due to faulty operation or a combination of unfavorable conditions or overloading of the pump, liquid should reach the pressure equalization chamber, the liquid can then be monitored visually by means of the observation device or automatically by means of the moisture measuring probe, and the liquid can be removed. The evacuation of the pressure equalization chambers can be effected either by separate lines leading to the outside or by suitable lines connected to the expansion chamber of the pump. In the latter case, a zeolite trap may be arranged in the line in order to keep the chamber free of oil. The pressure difference between the pressure equalization chamber and the suction manifold is used to produce the necessary flow.

In accordance with another feature of the present invention, the pressure equalization chambers may be filled with inert gas in order to prevent harmful gases and vapors from entering these chambers.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
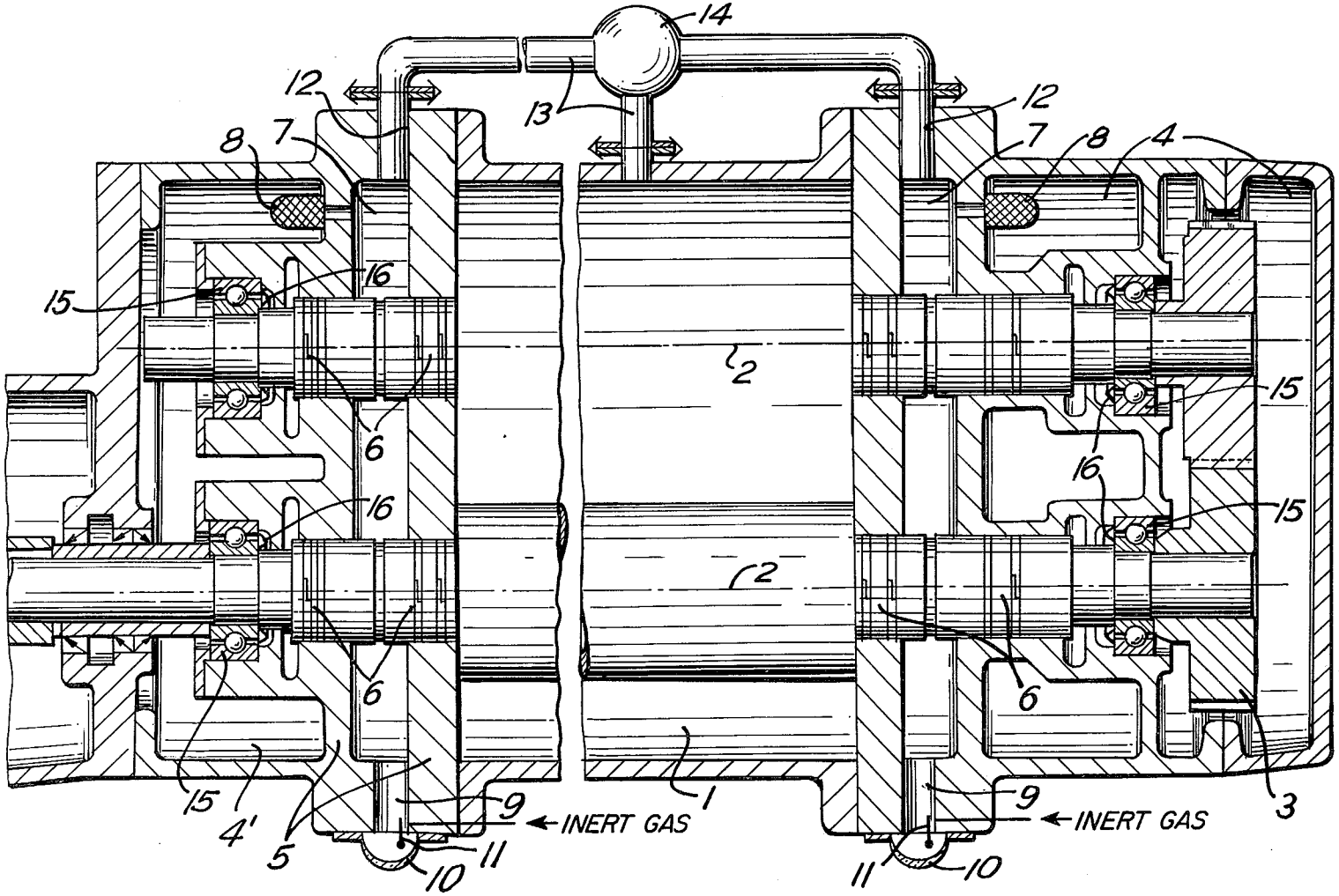
FIG. 1 is a sectional view of a rotary piston pump in accordance with the present invention.

As illustrated in the drawing, the rotary piston pump in accordance with the present invention includes two rotary pistons 2 rotating in an expansion chamber 1. The rotary movement of the pistons 2 is controlled by gears 3 located in a gear and bearing chamber 4. A bearing chamber 4' is located on the opposite side of the expansion chamber 1 from the gear and bearing chamber 4. Partitions 5 between the chambers 4, 4' and the expansion chamber 1 are provided with passages which receive shafts serving for the transmission of the rotary movement from the gears 3 to the pistons 2. The chambers 4, 4' are separated from the expansion chamber 1 by means of split seals 6.

In accordance with the present invention, the split seals 6 are separated by pressure equalization chambers 7. These pressure equalization chambers 7 connect all of the shaft passages located on one side of the expansion chamber 1. The pressure difference between pressure equalization chambers 7 and gear and bearing chamber 4 is equalized over separate oil filters 8. First bores 9 opening into the pressure equalization chambers 7 are provided with inspection windows 10 and moisture measuring probes 11 for monitoring the operation of the pump. Second bores 12 opening into the pressure equalization chambers 7 are at their outward ends provided with devices suitable for evacuating the pressure equalization chambers 7. This evacuation can be effected by means of lines 13 which are in communication with the expansion chamber 1 and are additionally provided with zeolite traps 14. An additional protection of the split seals 6 and of the expansion chamber 1 against spray oil is afforded by cover plates 16 or cover rings provided at ball bearings 15.

A line can be provided into each expansion chamber 7 for continuously circulating inert gas through the chambers for preventing harmful gases and vapors from entering these chambers.

While a specific embodiment of the invention has been shown and described in detail to illustrate the application of the inventive principles, it will be understood that the invention may be embodied otherwise without departing from such principles.

We claim:

1. A rotary piston pump comprising a casing and partitions within said casing and defining therein an expansion chamber having opposite sides with a gear and bearing chamber on one side of said expansion chamber and a bearing chamber on the opposite side with said partitions separating said gear and bearing chamber and said bearing chamber from said expansion chamber, at least two shafts each extending between said gear and bearing chamber and said bearing chamber through said partitions into said expansion chamber, said partitions forming passages for receiving said shafts, split seals provided in said shaft passages and separating said gear and bearing chamber and said bearing chamber from said expansion chamber, each said split seal comprising two parts, said partitions defining pressure equalization chambers located between said gear and bearing chamber and said expansion chamber and between said bearing chamber and said expansion chamber and extending across said shaft passages and separating said two parts of said split seals, oil filters arranged between said pressure equalization chambers and the adjacent said gear and bearing chamber and bearing chamber located on the same side of said expansion chamber for equalizing the pressure difference therebetween, at least one of said casing and partitions form bores opening into said pressure equalization chambers, and vacuum-tight inspection windows arranged in said bores.

2. A rotary piston pump in accordance with claim 1, wherein each of said pressure equalization chambers connects all of said shaft passages located on one side of said expansion chamber.

3. A rotary piston pump in accordance with claim 1, wherein moisture measuring probes are arranged in said bores.

4. A rotary piston pump in accordance with claim 1, comprising means located on the outside of said casing and in communication with said pressure equalization chambers for evacuating said pressure equalization chambers.

5. A rotary piston pump in accordance with claim 1, comprising lines connecting said pressure equalization chambers with said expansion chamber for evacuating said pressure equalization chambers.

6. A rotary piston pump in accordance with claim 5, comprising zeolite traps in said connecting lines.

7. A rotary piston pump in accordance with claim 1, comprising bearings arranged on said shafts, and cover plates are arranged on one side of each of said bearings.

8. A rotary piston pump in accordance with claim 1, comprising bearings arranged on said shafts, and cover rings are arranged adjacent said bearings.

9. A rotary piston pump in accordance with claim 1, wherein said pressure equalization chambers are filled with inert gas.

* * * * *